US011545763B2

(12) United States Patent
Lybrand

(10) Patent No.: US 11,545,763 B2
(45) Date of Patent: Jan. 3, 2023

(54) WIRE-TO-WIRE CONNECTOR WITH SPLICE CONTACT PORTION

(71) Applicant: KYOCERA AVX Components Corporation, Fountain Inn, SC (US)

(72) Inventor: Brent Lybrand, Fountain Inn, SC (US)

(73) Assignee: KYOCERA AVX Components Corporation, Fountain Inn, SC (US)

( * ) Notice: Subject to any disclaimer, the term of this patent is extended or adjusted under 35 U.S.C. 154(b) by 11 days.

(21) Appl. No.: 17/148,886

(22) Filed: Jan. 14, 2021

(65) Prior Publication Data

US 2021/0249797 A1 Aug. 12, 2021

Related U.S. Application Data

(60) Provisional application No. 62/972,416, filed on Feb. 10, 2020.

(51) Int. Cl.

| | |
|---|---|
| ***H01R 4/48*** | (2006.01) |
| ***H01R 4/70*** | (2006.01) |
| ***H01R 11/07*** | (2006.01) |
| ***H01R 11/09*** | (2006.01) |

(52) U.S. Cl.

CPC ..... *H01R 4/48* (2013.01); *H01R 4/70* (2013.01); *H01R 11/07* (2013.01); *H01R 11/09* (2013.01)

(58) Field of Classification Search

CPC . H01R 4/70; H01R 4/48; H01R 11/07; H01R 11/09

See application file for complete search history.

(56) References Cited

U.S. PATENT DOCUMENTS

| | | | | |
|---|---|---|---|---|
| 4,653,842 | A * | 3/1987 | Kirma | H01R 31/02 439/861 |
| 5,160,282 | A * | 11/1992 | Swaffield | H01R 31/02 439/724 |
| 5,540,602 | A * | 7/1996 | Bell | H01R 31/08 439/721 |
| 10,476,202 | B2 * | 11/2019 | Lybrand | H01R 4/2406 |
| 11,228,152 | B2 * | 1/2022 | Miyamura | H02G 15/08 |
| 2015/0311603 | A1 | 10/2015 | Bishop | |
| 2018/0118137 | A1 | 5/2018 | Tsukamoto | |

FOREIGN PATENT DOCUMENTS

| | | | |
|---|---|---|---|
| JP | 2014-116097 | A | 4/2021 |
| KR | 101386226 | B1 | 4/2014 |
| KR | 1020170078000 | A | 4/2021 |

OTHER PUBLICATIONS

International Search Report and Written Opinion in PCT/IB2021/050306 dated Apr. 21, 2021 (8 pages).

* cited by examiner

*Primary Examiner* — Briggitte R. Hammond
(74) *Attorney, Agent, or Firm* — Foley & Lardner LLP

(57) ABSTRACT

A contact for a wire-to-wire electrical connector includes a first contact portion defining a first wire receiving opening to receive a first wire and a second wire receiving opening to receive a second wire. The contact further includes a splice contact portion abutting the first contact portion and defining a third wire receiving opening to receive a third wire. The first contact portion also includes a first plurality of contact tines to electrically connect the first wire and the second wire and the splice contact portion includes a second plurality of contact tines to electrically connect the third wire to the first wire and the second wire.

18 Claims, 10 Drawing Sheets

WIRE-TO-WIRE CONNECTOR WITH SPLICE CONTACT PORTION

CROSS REFERENCE TO RELATED APPLICATION

The present application claims priority to U.S. Provisional Patent Application No. 62/972,416, which is incorporated herein in its entirety.

FIELD

The present application relates generally to the field of electrical connectors, and more particularly to a type of connector used to electrically connect one wire to at least one other wire.

BACKGROUND

The following description is provided to assist the understanding of the reader. None of the information provided or references cited are admitted to be prior art.

Various types of connectors are used for forming electrical connections between a wire and any manner of electronic or electrical component. These connectors are typically available as sockets, plugs, and shrouded headers in a vast range of sizes, pitches, and plating options. Traditionally, for two wires to be connected together, a user must strip the first and second wires, twist the two ends together, and then secure them to one other. This process can be tedious, inefficient, and undesirable. Furthermore, a wire-to-wire connection that may fall apart or short out unexpectedly could be hazardous or even deadly. Thus, a quick, efficient, and reliable means of connecting and disconnecting wires is needed.

SUMMARY

The systems, methods and devices of this disclosure each have several innovative aspects, no single one of which is solely responsible for the desirable attributes disclosed herein.

In accordance with some embodiments of the present disclosure, a contact for a wire-to-wire connector is disclosed. The contact includes a first contact portion defining a first wire receiving opening to receive a first wire and a second wire receiving opening to receive a second wire. The contact also includes a splice contact portion abutting the first contact portion and defining a third wire receiving opening to receive a third wire. The first contact portion includes a first plurality of contact tines to electrically connect the first wire and the second wire, and the splice contact portion includes a second plurality of contact tines to electrically connect the third wire to the first wire and the second wire.

In accordance with some embodiments of the present disclosure, a contact for a wire-to-wire connector is disclosed. The contact includes a first contact portion having a first wire receiving opening to receive a first wire, a second wire receiving opening to receive a second wire, and a first tab on a first wall of the first contact portion and a first recess on a second wall of the first contact portion. The first tab is configured to engage with the first recess to define the first wire receiving opening and the second wire receiving opening. The contact also includes a splice contact portion abutting the first contact portion and having a third wire receiving opening to receive a third wire and a second tab on a third wall of the splice contact portion and a second recess on a fourth wall of the splice contact portion. The second tab is configured to engage with the second recess to define the third wire receiving opening.

In accordance with some embodiments of the present disclosure, a contact for a wire-to-wire connector is disclosed. The contact includes a first contact portion having a first tab on a first wall of the first contact portion and a first recess on a second wall of the first contact portion. The first tab is configured to engage with the first recess to define a first wire receiving opening to receive a first wire and a second wire receiving opening to receive a second wire, and a plurality of contact tines to electrically connect the first wire to the second wire.

DETAILED DESCRIPTION

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is a wire-to-wire connector that includes a housing and a contact having a first contact portion and a splice contact portion. The contact may be used to electrically connect multiple wires. Specifically, the contact provides a high current carrying capability to efficiently and reliably mechanically and electrically couple the multiple wires to each other via a single one-piece connector. The contact provides additional rigidity and mechanical robustness to the connector, as well as to the connection between the multiple wires by using a unique tab/recess configuration. Further, the contact provides multiple points of electrical contact to the wires, thereby increasing the current flow through the contact. Thus, the contact allows for efficient and rapid creation of an electrical and mechanical connection between conductive portions of the wires without soldering or crimping the wires. Furthermore, the unique design of the contact allows for the contact to be constructed out of a single piece of conductive material. This construction minimizes the number of components that must be manufactured and connected to one another to form the contact, and thus simplifies the manufacturing process.

Figure 1:
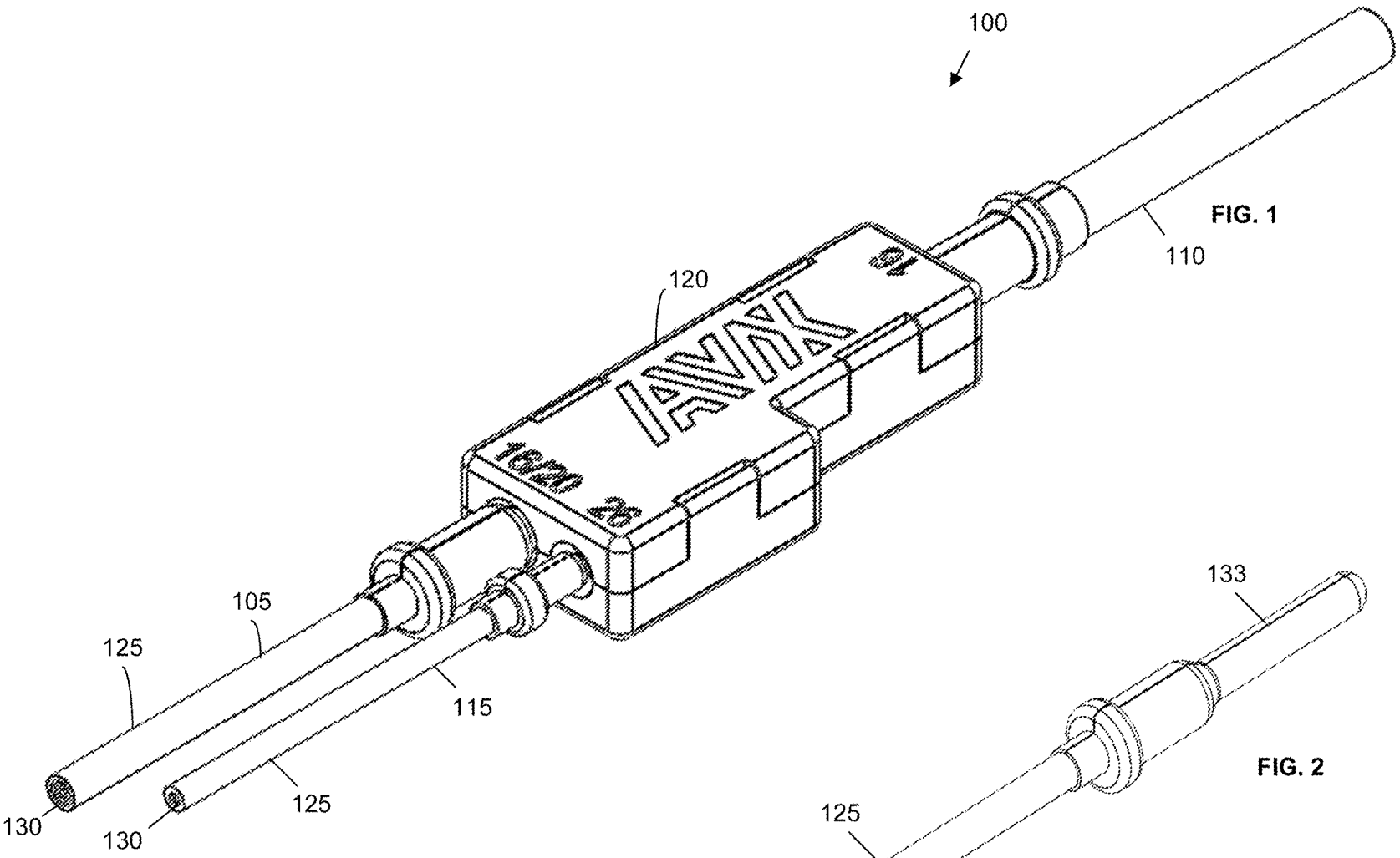
FIG. 1 is a perspective view of an electrical connector having a plurality of wires inserted therein, in accordance with some embodiments of the present disclosure.

Referring to FIG. 1, a perspective view of an example electrical connector 100 is shown, in accordance with some embodiments of the present disclosure. The electrical connector 100 is a wire-to-wire connector that is configured to mechanically and electrically connect a first wire 105 to a second wire 110 and a third wire 115 via an electrically conductive contact disposed within a housing 120. The housing 120 of the electrical connector 100 may be formed from any suitable non-conductive material. The shape and size of the housing 120 may vary based upon the shape and size of the contact therein, as well as the number and types of wires that are to be connected. Although the electrical connector 100 is shown to connect three wires (e.g., the first wire 105, the second wire 110, and the third wire 115), in some embodiments, the electrical connector may be used to connect two wires or greater than three wires depending upon the configuration of the contact. In some embodiments, the first wire 105, the second wire 110, and the third wire 115 may each be similarly shaped and sized, while in other embodiments, one or more of those wires may have different shapes and/or sizes.

Figure 2:
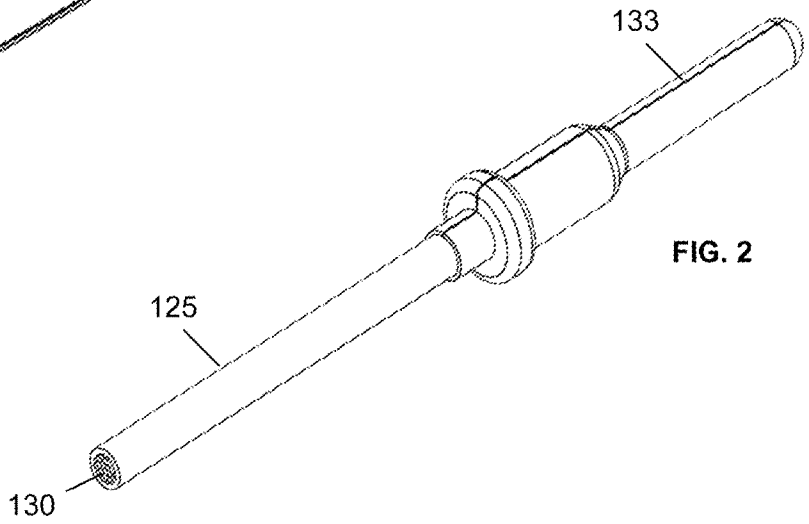
FIG. 2 is an example of a wire of the plurality of wires that may be inserted into the electrical connector of FIG. 1, in accordance with some embodiments of the present disclosure.

Further, the first wire 105, the second wire 110, and the third wire 115 may each include an outer insulative layer 125 and conductive core or strands 130. An example of a wire that may be used for the first wire 105, the second wire 110, and the third wire 115 is shown in FIG. 2. In some embodiments, an end portion of the outer insulative layer 125 of the first wire 105, the second wire 110, and the third wire 115 may be removed to expose the conductive core or strands 130, and an insertion portion 133 may be inserted over the exposed conductive core or strands of each wire. The insertion portion 133 may be constructed from a conductive material, and may be inserted into the electrical connector 100 to provide an electrical connection with other wires. As a result of stripping the outer insulative layer 125, covering the exposed conductive core or strands 130 of the first wire 105, the second wire 110, and the third wire 115 with the insertion portion 133 such that the conductive core or strands of those wires are pressed against or otherwise contact the conductive walls of the respective insertion portion, and inserting the insertion portions of those wires into the electrical connector 100, the conductive walls of the various insertion portions may create an electrical/mechanical connection between those wires. In some embodiments, the entirety of the portions of the first wire 105, the second wire 110, and the third wire 115 that extend outwardly from the housing 120 may not be stripped of their outer insulative layers (e.g., the outer insulative layer 125) to minimize safety concerns from the exposed conductive cores (e.g., the conductive core or strands 130). In some embodiments, the insertion portion 133 need not be used to cover the exposed ends of the first wire 105, the second wire 110, and the third wire 115. Rather, in such embodiments, the exposed ends of the first wire 105, the second wire 110, and the third wire 115 may be directly inserted into the electrical connector 100. Further, in some embodiments, one or more of the first wire 105, the second wire 110, and the third wire 115 may use the insertion portion 133, while the remaining ones of the wires may be directly inserted into the electrical connector 100 via their exposed ends. Additionally, although a portion of the insertion portion 133 is shown as extending outside of the housing 120 in FIG. 1, in some embodiments, the insertion portion may be completely encompassed within the housing.

Figure 3B:
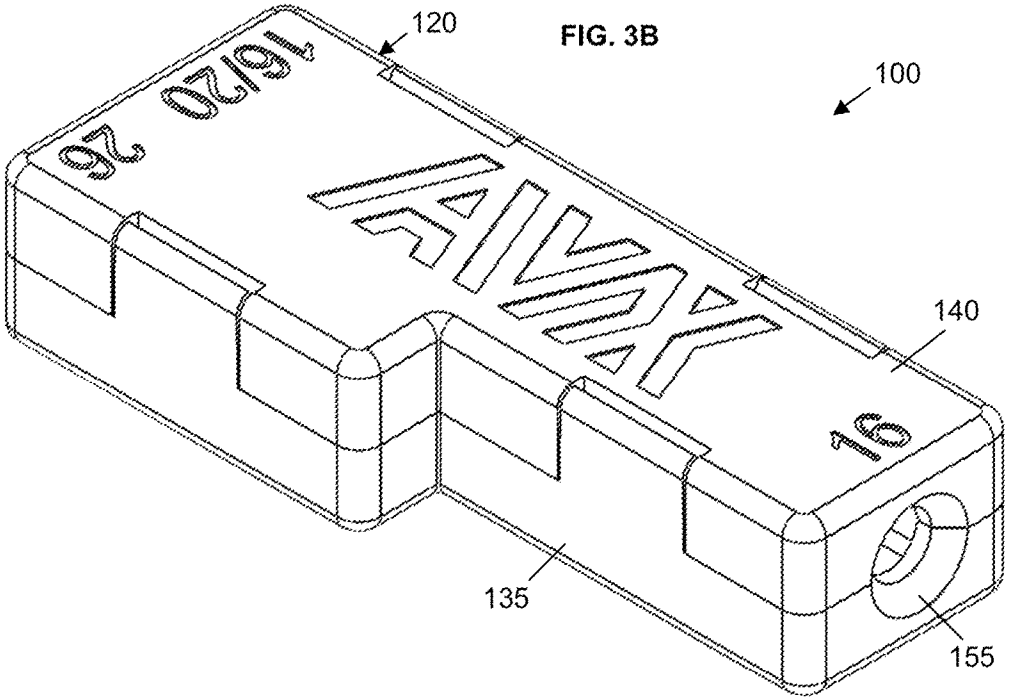
FIGS. 3A and 3B are perspective views of the electrical connector of FIG. 1 without the plurality of wires inserted therein, in accordance with some embodiments of the present disclosure.
Figure 3A:
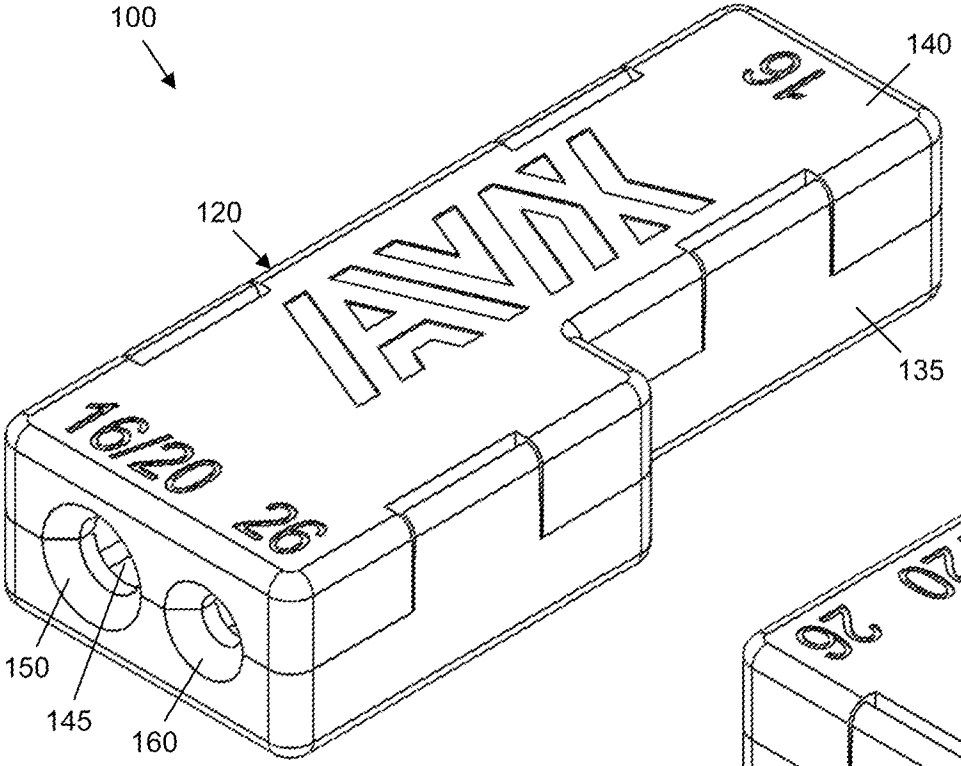
Figure 3C:
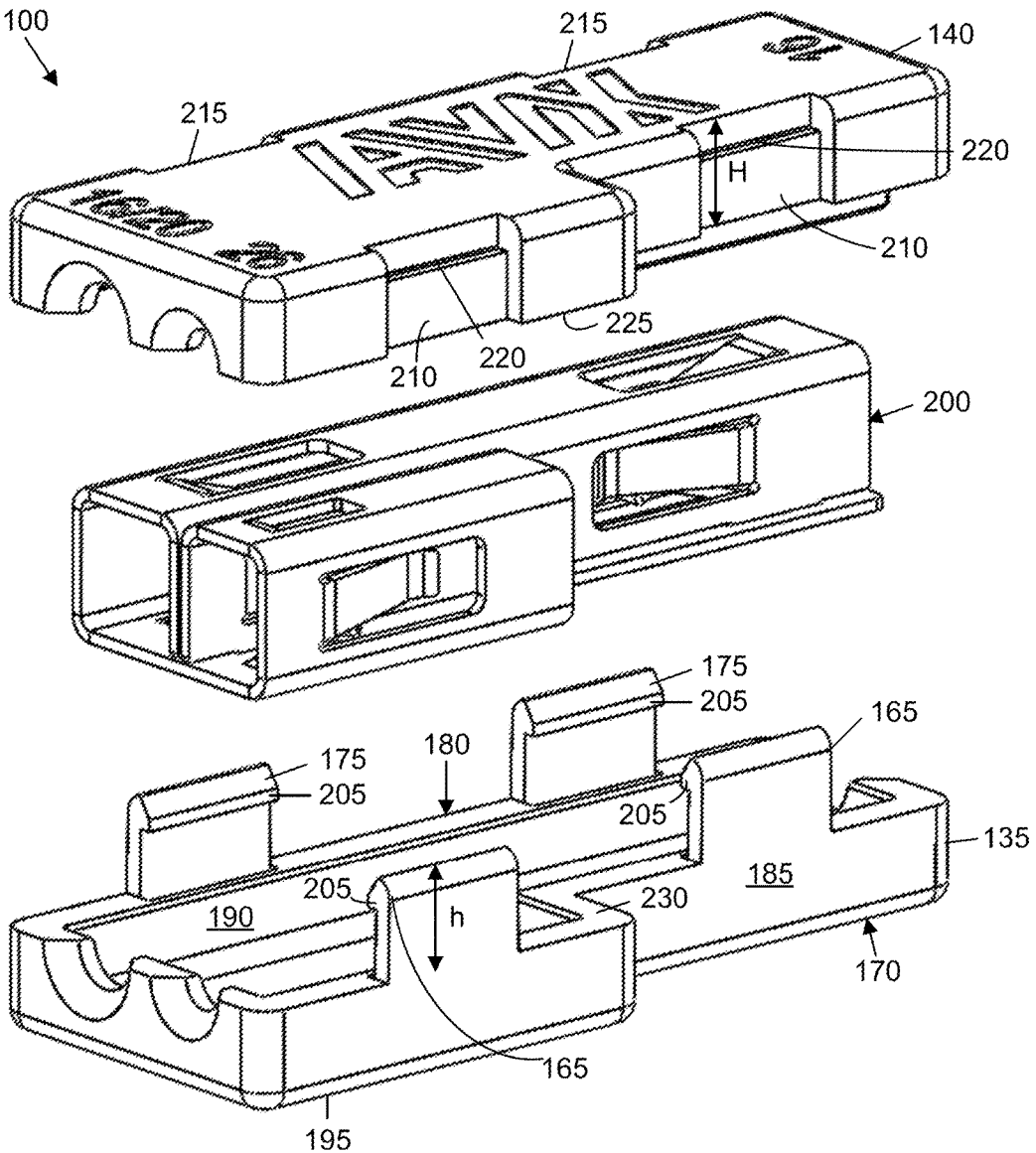
FIG. 3C is an exploded view of the electrical connector of FIGS. 3A and 3B, in accordance with some embodiments of the present disclosure.

Turning now to FIGS. 3A-3C, additional views of the electrical connector 100 are shown without the first wire 105, the second wire 110, and the third wire 115 inserted therein. FIGS. 3A and 3B show perspective views of the electrical connector 100, while FIG. 3C shows an exploded view of the electrical connector. The housing 120 of the electrical connector 100 may include a first portion 135 and a second portion 140. In some embodiments, both the first portion 135 and the second portion 140 may be constructed from an electrically-insulative material. In some embodiments, the first portion 135 and the second portion 140 may be constructed from the same material, while in other embodiments, different materials may be used. The first portion 135 may interlock with the second portion 140 to define a volume 145 therein within which the electrically conductive contact is disposed. Upon interlocking, the first portion 135 and the second portion 140 also define a plurality of openings. For example, upon interlocking, the first portion 135 and the second portion 140 define a first opening 150 at a first end of the housing 120 to receive the first wire 105, a second opening 155 at a second end of the housing to receive the second wire 110, and a third opening 160 at the first end of the housing to receive the third wire 115. Each of the first opening 150, the second opening 155, and the third opening 160 may be sized and shaped according to the size and shape of the wire that is to be inserted through that opening. Although three wire receiving openings (e.g., the first opening 150, the second opening 155, and the third opening 160) are shown herein to receive three wires (e.g., the first wire 105, the second wire 110, and the third wire 115), in other embodiments, greater or fewer number of openings may be provided based upon the number of wires that are to be connected within the electrical connector 100.

To interlock the first portion 135 with the second portion 140, the first portion may include one or more latching prongs around the periphery of the first portion and the second portion may include one or more cutouts around the periphery of the second portion. For example, the first portion 135 may include a first set of latching prongs 165 on a first side 170 of the first portion, and a second set of latching prongs 175 on a second side 180 of the first portion. In some embodiments, the number of prongs in the first set of latching prongs 165 may be same as the number of prongs in the second set of latching prongs. In other embodiments, the number of prongs in the first set of latching prongs 165 may vary from the number of prongs in the second set of latching prongs 175. Further, in some embodiments, each of the prongs in the first set of latching prongs 165 may be spaced apart from other prongs in the first set. Similarly, in some embodiments, each prong in the second set of latching prongs 175 may be spaced apart from other prongs in the second set. The positioning of the prongs in the first set of latching prongs 165 on the first side 170 and the prongs in the second set of latching prongs 175 on the second side 180 may vary from one embodiment to another. In some embodiments, each prong in the first set of latching prongs 165 may be diametrically or substantially diametrically opposite one prong of the second set of latching prongs 175, while in some embodiments, each prong of the first set of latching prongs may be offset from a prong of the second set of latching prongs. Additionally, the shape and size of each prong in the first set of latching prongs 165 and the second set of latching prongs 175 may be same in some embodiments, while in other embodiments, the shape and size of at least one prong may vary from the shape and size of other prongs in the first set of latching prongs and/or the second set of latching prongs.

Each prong in the first set of latching prongs 165 may extend outwardly from a side wall 185 of the first side 170. Similarly, each prong in the second set of latching prongs 175 may extend outwardly from a side wall 190 of the second side 180. The side walls 185 and 190 may in turn extend outwardly from a base 195 of the first portion 135 to define a cavity (e.g., part of the volume 145) within which a contact 200 is disposed. In some embodiments, the various elements (e.g., the first set of latching prongs 165, the second set of latching prongs 175, the side walls 185, 190, etc.) of the first portion 135 may be molded or formed as an integral piece. In other embodiments, one or more elements of the first portion 135 may be separately formed and connected together in operational association. Further, each prong in the first set of latching prongs 165 and the second set of latching prongs 175 may include a connection ridge 205 forming a hook-shaped portion extending towards the cavity of the first portion 135. The connection ridge 205 may be used to interlock the first portion 135 to the second portion 140 when the first set of latching prongs 165 and the second set of latching prongs 175 of the first portion mate with the second portion.

The second portion 140 may include cutouts or recesses to receive the first set of latching prongs 165 and the second set of latching prongs 175. For example, the second portion 140 may include a first set of cutouts 210 to receive the first set of latching prongs 165. The number of cutouts in the first set of cutouts 210 is equal to the number of prongs in the first set of latching prongs 165. Thus, each prong of the first set of latching prongs 165 is intended to mate with one cutout of the first set of cutouts 210. The positioning of the cutouts in the first set of cutouts 210 on the second portion 140 corresponds to the positioning of the first set of latching prongs 165 on the first portion 135. The second portion 140 may also include a second set of cutouts 215 to receive the second set of latching prongs 175. The number of cutouts in the second set of cutouts 215 is equal to the number of prongs in the second set of latching prongs 175. Thus, each prong of the second set of latching prongs 175 is intended to mate with one cutout of the second set of cutouts 215. The positioning of the cutouts in the second set of cutouts 215 on the second portion 140 corresponds to the positioning of the second set of latching prongs 175 on the first portion 135.

Further, each cutout in the first set of cutouts 210 and the second set of cutouts 215 may include a ridge 220 (only the ridges of the first set of cutouts are visible in FIG. 3C) on which the connection ridge 205 of the first set of latching prongs 165 and the second set of latching prongs 175 rest upon mating. In some embodiments, a particular cutout in the first set of cutouts 210 and the second set of cutouts 215 may have a height, H, that is substantially similar to a height, h, of the prong on the first portion 135 with which that particular cutout is to mate, such that upon assembly, a bottom edge 225 of the second portion 140 rests upon a top edge 230 of the first portion 135. Specifically, to assemble the electrical connector 100, the contact 200 may be disposed within the cavity of the first portion 135. Thus, upon assembly, the contact 200 may be encompassed between the first portion 135 and the second portion 140. Upon disposing the contact 200 within the cavity of the first portion 135, the first portion may be vertically aligned with the second portion 140 such that the first set of latching prongs 165 align with the first set of cutouts 210, and the second set of latching prongs 175 align with the second set of cutouts 215. The first portion 135 and the second portion 140 may then be press-fitted together until the connection ridges 205 of each of the first set of latching prongs 165 and the second set of latching prongs 175 engage with the corresponding ones of the ridges 220, thereby engaging and interlocking the first portion 135 and the second portion 140 together.

To disassemble the housing 120, the connection ridges 205 of the first set of latching prongs 165 and the second set of latching prongs 175 may be dis-engaged from the corresponding ridges 220 of the first set of cutouts 210 and the second set of cutouts 215 by, for example, applying an outward force to (e.g., by pulling the first portion 135 away from the second portion 140). Thus, the unique design of the housing 120 disclosed herein enables quick and easy assembly and disassembly. It is to be noted that although the housing 120 has been described as having a specific configuration of the first portion 135 and the second portion 140, alternative housing configurations are envisioned. For example, in some embodiments, another housing may include a first portion that substantially encloses a volume and a second portion at an end of the first portion. The second portion may attach (e.g., via a hinge) to the first portion at the end such that the housing substantially encloses a volume. This way, the contact 200 may be inserted into the first portion, and then covered by the second portion. Other configurations of the housing 120 are also contemplated. Further, in some embodiments, the configuration of the first portion 135 and the second portion 140 may vary such that other locking mechanisms to connect the first portion to the second portion are used. Generally speaking, the housing 120, including the first portion 135 and the second portion 140 may be provided in a variety of suitable forms that allow the contact 200 to be disposed within the housing in a suitable manner.

Additionally, although the housing 120 has been shown as including a single contact (e.g., the contact 200), in other embodiments, the housing may house a number of contacts, enabling any number electrical connections (e.g., two, four, six, etc.) to be formed between any number of wires. Thus, the electrical connector 100 is not limited by a maximum number of wire positions, contacts, or wire stops. Further, in some embodiments, insulative material may be disposed within the volume 145 between the contact 200 and the walls of the housing 120. Any additional components or elements that are desired or considered suitable to be disposed within the housing 120 may be inserted within the volume 145.

Figure 4A:
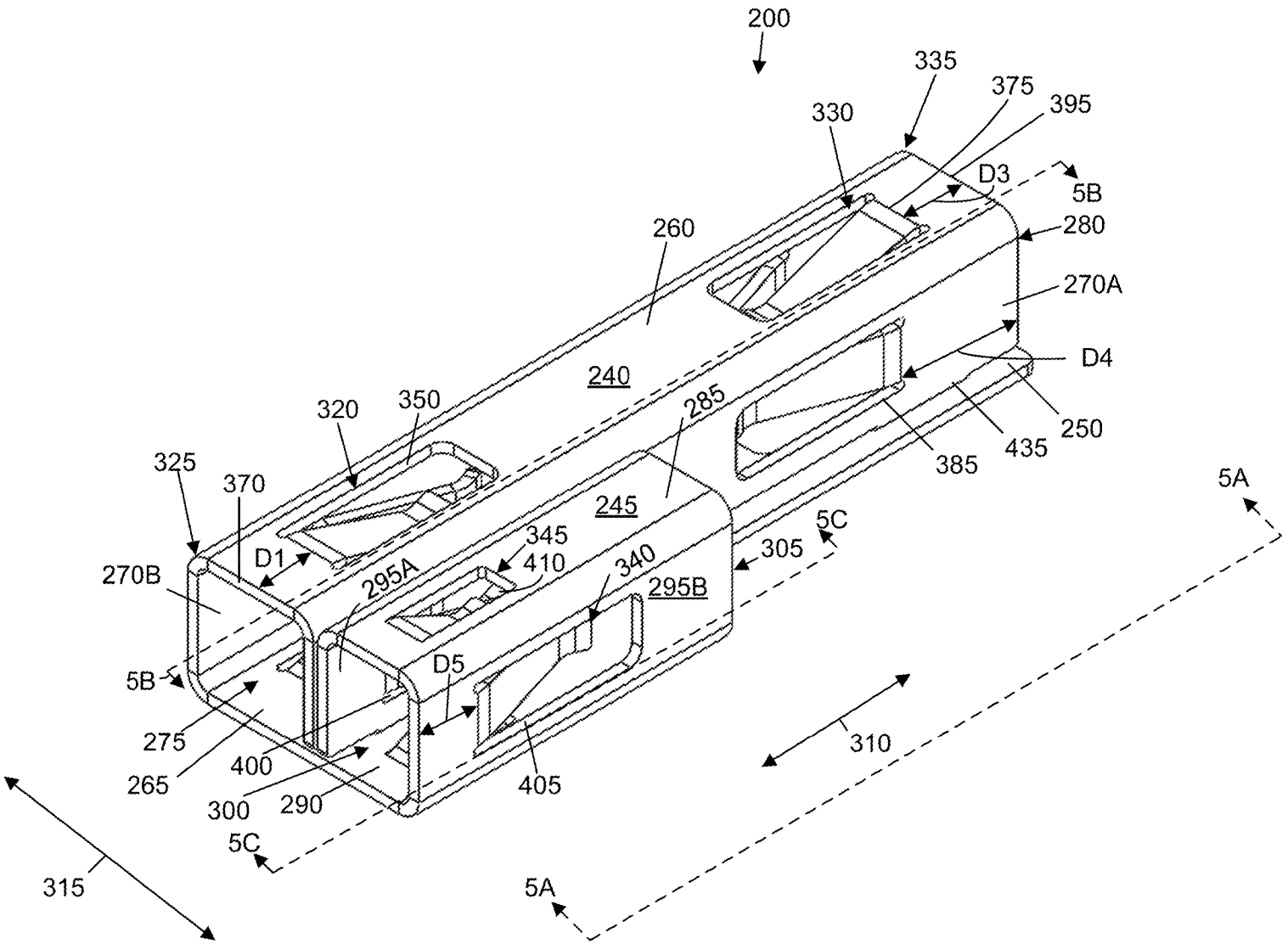
FIGS. 4A and 4B are perspective views of a contact of the electrical connector of FIGS. 3A and 3B, in accordance with some embodiments of the present disclosure.
Figure 4B:
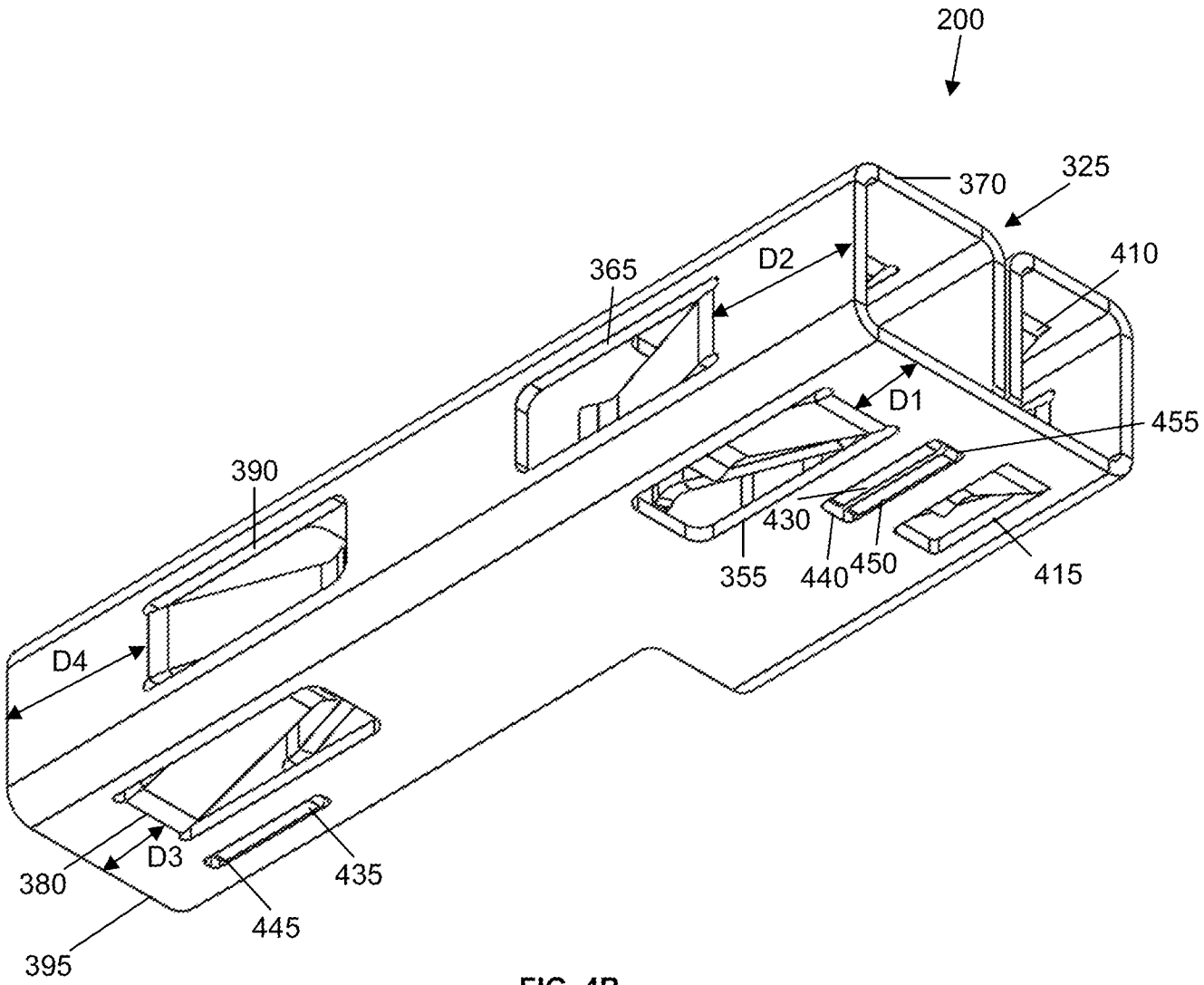

Turning now to FIGS. 4A and 4B, perspective views of the contact 200 are shown, in accordance with some embodiments of the present disclosure. Specifically, FIG. 4A shows a top perspective view of the contact 200, while FIG. 4B shows a bottom perspective view of the contact. In some embodiments, the contact 200 may be a "single element" conductive portion formed from a single conductive element (e.g., a single metal stamped sheet) having a gauge and other physical characteristics suitable for the application in which the electrical connector 100 is used. In some embodiments, the contact 200 may be formed by deforming, bending, or otherwise folding a single piece of conductive material into an enclosed structure having openings to receive the first wire 105, the second wire 110, and the third wire 115. The contact 200 may include a first contact portion 240 and a splice contact portion 245. The first contact portion 240 and the splice contact portion 245 may be formed from the single conductive element. In other words, a single conductive material (e.g., a metal sheet) may be deformed and molded to form the first contact portion 240 and the splice contact portion 245.

The first contact portion 240 includes a top wall 260 connected to a bottom wall 265 via side walls 270A and 270B defining a first wire receiving opening 275 at a first end of the first contact portion to receive the first wire 105 and a second wire receiving opening 280 at a second end of the first contact portion to receive the second wire 110. Although the second wire receiving opening 280 is not fully visible, in some embodiments, the second wire receiving opening may be identical or substantially identical to the first wire receiving opening 275. In some embodiments, the shape and size of the first wire receiving opening 275 and the second wire receiving opening 280 may be dependent upon the size and shape of the wire that is inserted through those openings. Thus, for example, in some embodiments, the first wire receiving opening 275 may be shaped and sized to accommodate the shape and size of the first wire 105, while the second wire receiving opening 280 may be shaped and sized to accommodate the second wire 110. Similarly, the splice contact portion 245 may include a top wall 285 connected to a bottom wall 290 via side walls 295A and 295B to define a third wire receiving opening 300 at a first end of the splice contact portion to receive the third wire 115, and a fourth wire receiving opening 305 at a second end of the splice contact portion to possibly receive a fourth wire. Although the fourth wire receiving opening 305 is not fully visible, in some embodiments, the fourth wire receiving opening may be identical or substantially identical to the third wire receiving opening 300. In some embodiments, the shape and size of the third wire receiving opening 300 and the fourth wire receiving opening 305 may be dependent upon the size and shape of the wire that is inserted through those openings. Thus, for example, in some embodiments, the third wire receiving opening 300 may be shaped and sized to accommodate the shape and size of the third wire 115. In some embodiments, where a fourth wire is not to be inserted into the splice contact portion 245, the fourth wire receiving opening 305 may be closed off.

Although the first contact portion 240 and the splice contact portion 245 are shown as having rectangular configurations, in other embodiments, one or more walls (e.g., the top wall 260, the bottom wall 265, the side walls 270A, 270B) of the first contact portion and one or more walls (e.g., the top wall 285, the bottom wall 290, the side walls 295A, 295B) of the splice contact portion may be shaped differently to provide other configurations (e.g., circular, semicircular, etc.) of the first contact portion and/or the splice contact portion. Further, in some embodiments, the first contact portion 240 may extend farther than the splice contact portion 245 in a first direction 310. In other embodiments, the first contact portion 240 may have a similar length as the splice contact portion 245 in the first direction 310. Likewise, the first contact portion 240 may have the same or different width than the splice contact portion 245 in a second direction 315. The first contact portion 240 and the splice contact portion 245 may be formed from a single conductive material, as described in greater detail below. Further, in some embodiments, the side wall 270A of the first contact portion 240 and the side wall 295A of the splice contact portion 245 may be adjacent to each other, or in other words, abut each other. By being adjacent to each other or by abutting each other, the side walls 270A and 295A may provide support to one another during the wire insertion process. Further, by being adjacent or abutting each other, the side walls 270A and 295A may maintain a mating force therebetween, thereby ensuring electrical continuity between the first contact portion 240 and the splice contact portion 245 through those side walls.

Each of the first contact portion 240 and the splice contact portion 245 may include a plurality of contact tines that are biased into the first contact portion and the splice contact portion. Specifically, the first contact portion 240 may include a first set of contact tines 320 adjacent to a first end 325 of the first contact portion and a second set of contact tines 330 adjacent to a second end 335 of the first contact portion. The splice contact portion 245 may include a third set of contact tines 340 and a set of wire guides 345. In some embodiments, each of the first set of contact tines 320, the second set of contact tines 330, and the third set of contact tines 340, as well as the set of wire guides 345 may be defined by sections or cutouts in the single sheet conductive material from which the first contact portion 240 and the splice contact portion 245 are formed.

The first set of contact tines 320 on the first contact portion 240 may include four contact tines—with one contact tine on each of the top wall 260, the bottom wall 265, the side wall 270A, and the side wall 270. Thus, the first set of contact tines 320 may include a contact tine 350 on the top wall 260, a contact tine 355 (see FIG. 4B) on the bottom wall 265, a contact tine 360 (see FIG. 6A) on the side wall 270A, and a contact tine 365 (see FIG. 4B) on the side wall 270B. The contact tine 350 on the top wall 260 and the contact tine 355 on the bottom wall 265 may be aligned such that those contact tines are formed at a first distance, D1, from an edge 370 of the first end 325. The contact tine 360 on the side wall 270A and the contact tine 365 on the side wall 270B may also be aligned with each other such that those contact tines are formed at a distance, D2, from the edge 370 of the first end 325. The contact tines 350/355 are offset from the contact tines 360/365. In some embodiments, the distance, D2, is greater than the distance, D1. In other embodiments, the distance, D2, may be less than the distance, D1, while in some embodiments, the distances D1 and D2 may be same or substantially similar. By virtue of forming pairs of contact tines at offset locations, the first wire 105 may be guided and held in two locations—one location defined by the contact tines 350/355 and another location defined by the contact tines 360/365—thereby improving the alignment of the first wire into the first contact portion 240, reducing the movement of the first wire within the first contact portion, as well as reducing the total force applied to the first wire at a particular location. For example, the force applied to the first wire 105 at a particular location by a pair of contact tines (e.g., a first pair formed by the contact tines 350/355 and a second pair formed by the contact tines 360/365) is less than the force applied to the first wire at that location by the two pairs of contact tines combined, thereby preventing the first wire from being crimped and damaged. Further, the offset between the contact tines 350/355 and the contact tines 360/365 may reduce the amount of force required to insert the wire being inserted through a particular pair of contact tines.

The second set of contact tines 330 on the first contact portion 240 may also include four contact tines—with one contact tine on each of the top wall 260, the bottom wall 265, the side wall 270A, and the side wall 270. Thus, the second set of contact tines 330 may include a contact tine 375 on the top wall 260, a contact tine 380 (see FIG. 4B) on the bottom wall 265, a contact tine 385 on the side wall 270A, and a contact tine 390 (see FIG. 4B) on the side wall 270B. The contact tine 375 on the top wall 260 and the contact tine 380 on the bottom wall 265 may be aligned such that those contact tines are formed at a first distance, D3, from an edge 395 of the second end 335. The contact tine 385 on the side wall 270A and the contact tine 390 on the side wall 270B may also be aligned with each other such that those contact tines are formed at a distance, D4, from the edge 395 of the second end 335. Thus, the contact tines 375/380 are offset from the contact tines 385/390. In some embodiments, the distance, D4, is greater than the distance, D3. In other embodiments, the distance, D4, may be less than the distance, D3, while in some embodiments, the distances D3 and D4 may be same or substantially similar. By virtue of forming pairs of contact tines 375/380 and 385/390 at offset locations, the second wire 110 may be guided and held in two locations, thereby improving the alignment of the second wire into the first contact portion 240, reducing the movement of the second wire within the first contact portion, as well as reducing the total force applied to the second wire at a particular location. In some embodiments, the distance, D1, may be same or similar as the distance D3, while the distance, D2, may be same or similar as the distance D4. In other embodiments, the distance, D1, may be different from the distance D3 and/or the distance, D2, may be different from the distance, D4.

Although each of the first set of contact tines 320 and the second set of contact tines 330 have been described as having four contact tines, in some embodiments, either or both the first and the second set of contact tines may have fewer than or greater than four contact tines. Further, although each of the first set of contact tines 320 and the second set of contact tines 330 have been described as having the same number of contact tines, in some embodiments, the number of contact tines in the first set of contact tines may vary from the number of contact tines in the second set of contact tines. Additionally, although a single contact tine has been shown on each of the top wall 260, the bottom wall 265, and the side walls 270A, 270B for each of the first set of contact tines 320 and the second set of contact tines 330, in some embodiments, no contact tine or more than one contact tine may be provided on a particular wall for the first set of contact tines and/or the second set of contact tines. Moreover, in some embodiments, an additional set of contact tines having one or more contact tines may be provided between the first set of contact tines 320 and the second set of contact tines 330.

The third set of contact tines 340 may include a contact tine 400 on the side wall 295A and a contact tine 405 on the side wall 295B. Thus, as opposed to the first set of contact tines 320 and the second set of contact tines 330 that each include four contact tines, the third set of contact tines 340 includes two contact tines—one contact tine on each side wall of the splice contact portion 245. The contact tine 400 and the contact tine 405 may be aligned with each other such that both contact tines are formed at a distance, D5, from the edge 370 of the first end 325. In some embodiments, the distance, D5 is same as the distance, D1, or the distance, D2, while in other embodiments, the distance, D5, is greater than or less than the distance, D1, or the distance, D2. Although two contact tines are described in the third set of contact tines 340, in some embodiments, the third set of contact tines may include greater than or fewer than two contact tines. In some embodiments, one or more contact tines may also be provided on either or both of the top wall 285 and the bottom wall 290. When provided on the top wall 285 and the bottom wall 290, in some embodiments, those contact tines may be offset from the contact tines of the side walls 295A, 295B similar to the offset described above with respect to the first set of contact tines 320 and the second set of contact tines 330.

Further, in some embodiments, each contact tine in the first set of contact tines 320, the second set of contact tines 330, and the third set of contact tines 340 may be sized and shaped the same or similar. In other embodiments, a contact tine of the first set of contact tines 320, the second set of contact tines 330, and the third set of contact tines 340 may be shaped and/or sized differently than another contact tine of those sets of contact tines. In some embodiments, the contact tines that are aligned with each other may be similarly sized and shaped. For example, in some embodiments, the contact tine 350 may be similarly sized and shaped as the contact tine 355. Likewise, in some embodiments, the contact tines 360 and 365 may be similarly sized and shaped, the contact tines 375 and 380 may be similarly sized and shaped, the contact tines 385 and 390 may be similarly sized and shaped, and the contact tines 400 and 405 may be similarly sized and shaped. In some embodiments, the size of a contact tine may be dependent upon the size of the wall on which that contact tine is formed. For example, a contact tine on a wider wall may be wider, in some embodiments, than a contact tine on a narrower wall.

The set of wire guides 345 may include a first wire guide 410 on the top wall 285 of the splice contact portion 245 and a second wire guide 415 (see FIG. 4B) on the bottom wall 290 of the splice contact portion. The first wire guide 410 and the second wire guide 415 may be configured to physically guide and align the third wire 115 within the splice contact portion 245 away from the top wall 285 and the bottom wall 290, and through the first set of contact tines 340. In some embodiments, the first wire guide 410 may be similarly sized and shaped as the second wire guide 415, while in other embodiments, the shapes and/or sizes of those wire guide may be different. Also, in some embodiments, the set of wire guides 345 may be similarly shaped, albeit smaller in size, than a contact tine in the first set of contact tines 320, the second set of contact tines 330, and/or the third set of contact tines 340. In other embodiments, the set of wire guides 345 may be differently shaped and/or similarly sized as a contact tine in the first set of contact tines 320, the second set of contact tines 330, and/or the third set of contact tines 340. Further, in some embodiments, the first wire guide 410 and the second wire guide 415 may each be formed at the distance, D5, from the edge 370. In other embodiments, the first wire guide 410 and/or the second wire guide 415 may be formed at a distance that is either greater than or less than the distance, D5, such that those wire guides are offset from the contact tines 400, 405.

Figure 5A:
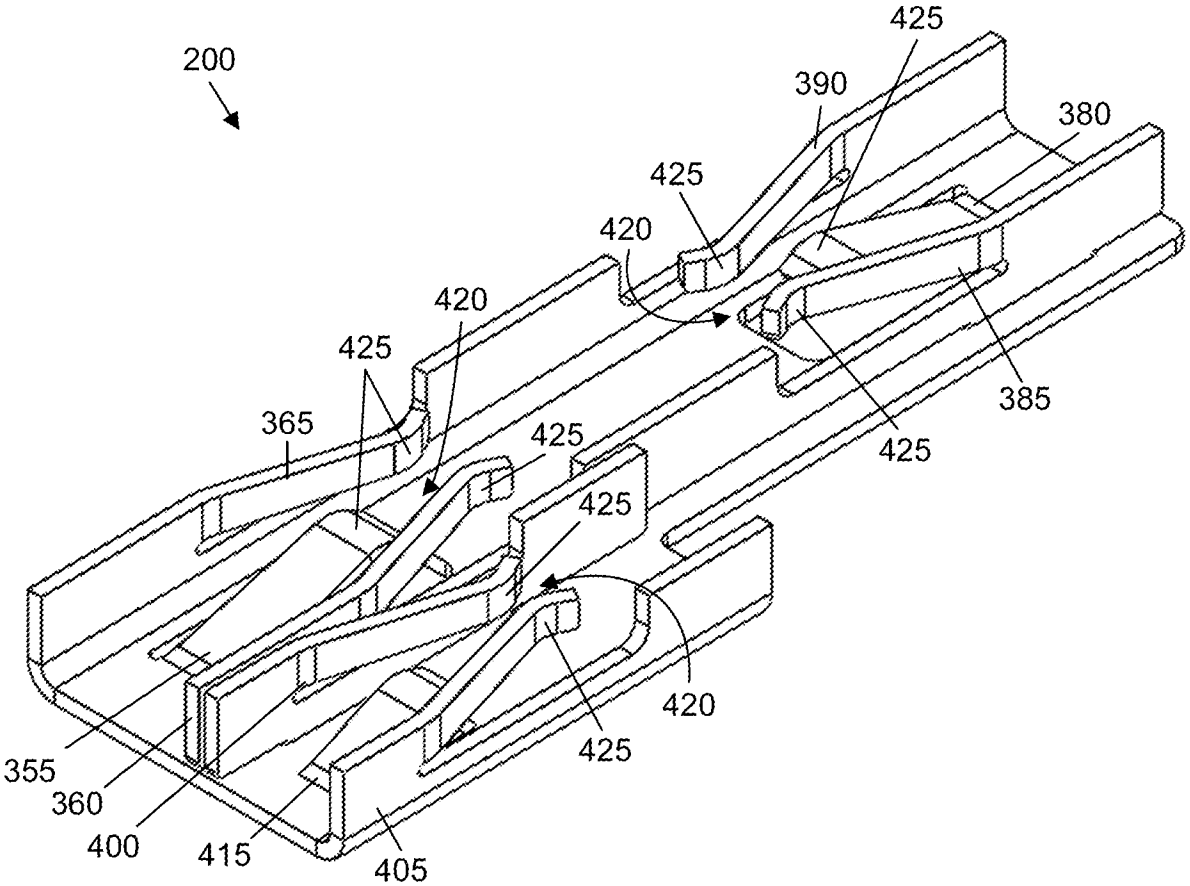
FIGS. 5A-5C are cross sectional views of a first contact portion and a splice contact portion of the contact of FIGS. 4A and 4B, in accordance with some embodiments of the present disclosure.
Figure 5B:
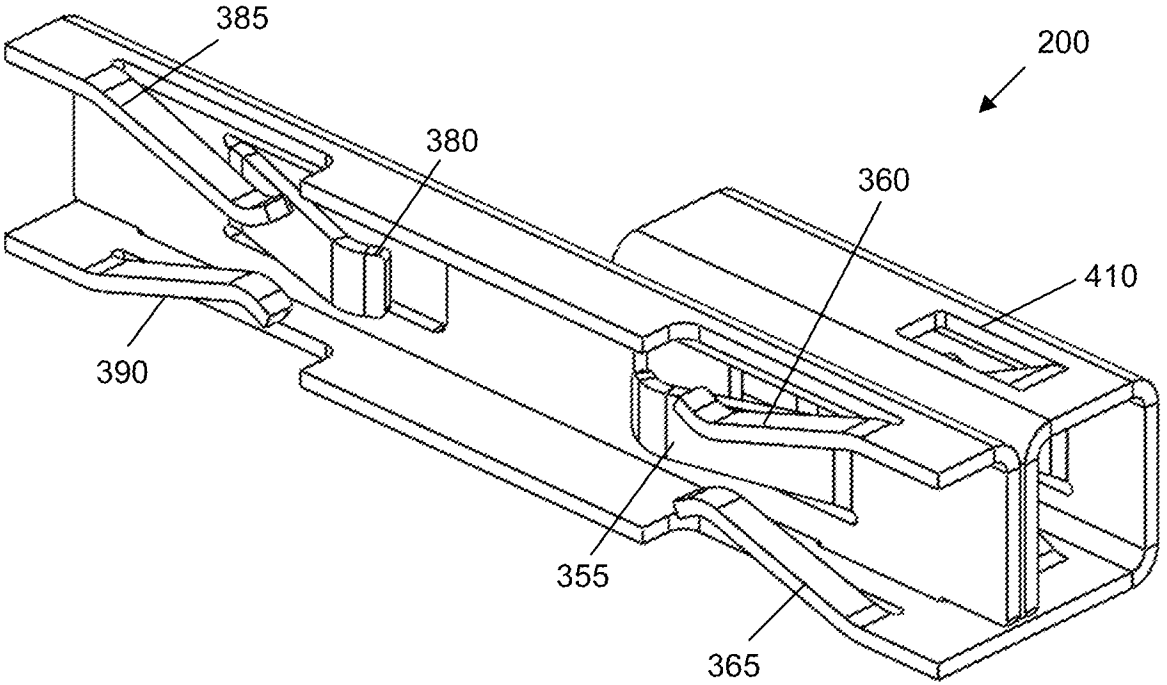
Figure 5C:
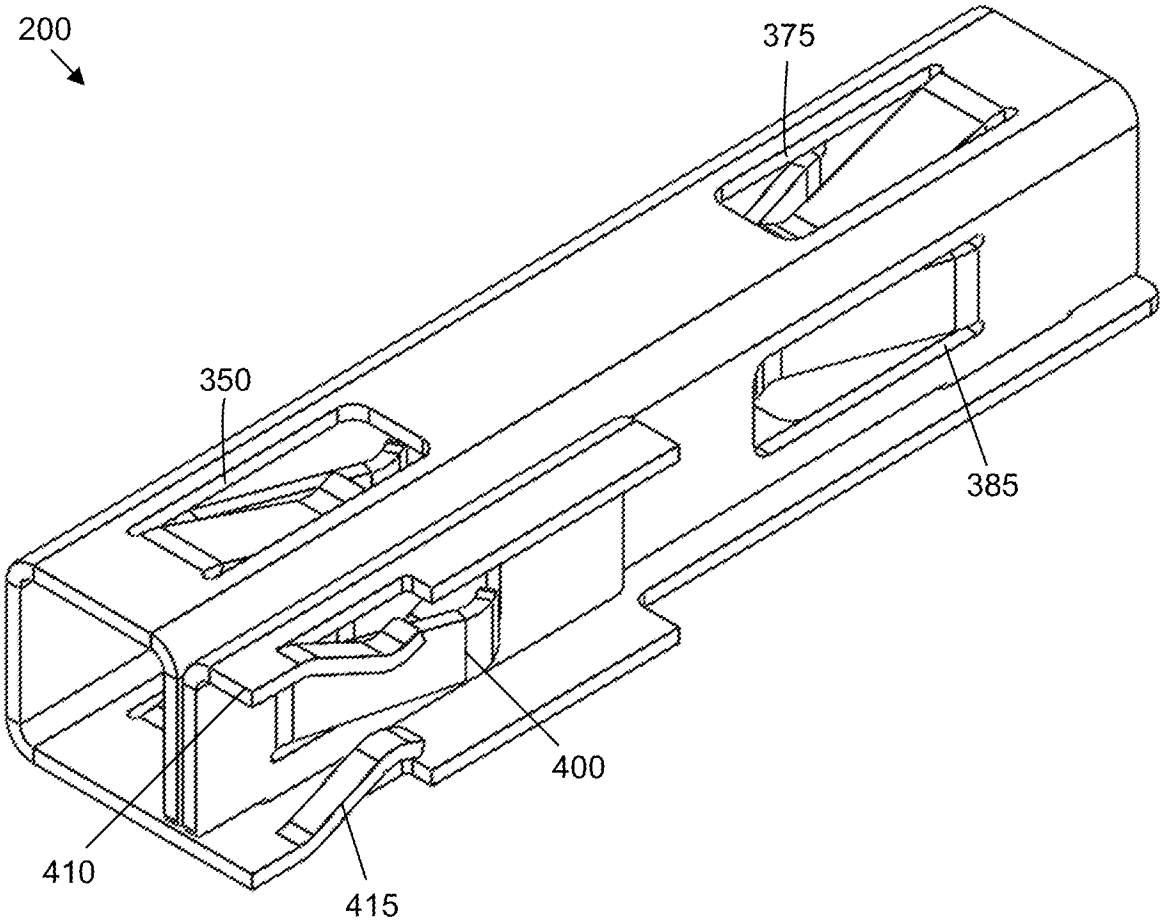

The structure of the wire guides in the set of wire guides 345, as well the structure of the contact tines in the first set of contact tines 320, the second set of contact tines 330, and the third set of contact tines 340 may be better understood by referring to FIGS. 5A-5C. Thus, referring to FIGS. 5A-5C in conjunction with FIGS. 4A-4B, various cross-sectional views of the contact 200 are shown, in accordance with some embodiments of the present disclosure. FIG. 5A shows the cross-sectional view of the contact 200 along line 5A-5A of FIG. 4A. Essentially, the cross-sectional view of FIG. 5A is the view with the top wall 260 and the top wall 285 removed. FIG. 5B shows a cross-sectional view along lines 5B-5B of FIG. 4A, while FIG. 5C shows a cross-sectional view along lines 5C-5C of FIG. 4A.

As shown in FIGS. 5A-5C, each contact tine in the first set of contact tines 320, the second set of contact tines 330, and the third set of contact tines 340 may be defined by cutouts in the walls (e.g., the top wall 260, the bottom wall 265, the side walls 270A, 270B, the top wall 285, the bottom wall 290, the side walls 295A, 295B) in the first contact portion 240 and the splice contact portion 245. The cutouts may be bent or angled inwards towards a cavity formed by the first contact portion 240 and the splice contact portion 245 into which the first wire 105, the second wire 110, and the third wire 115 are inserted. Further, as shown, the pairs of contact tines that are aligned with each other may be biased towards each other to define a pinch point 420. Thus, for example, the contact tines 350 and 355 may be biased toward each other to define the pinch point 420, the contact tines 360 and 365 may be biased towards each other to define the pinch point, the contact tines 375 and 380 may be biased towards each other to define the pinch point, the contact tines 385 and 390 may be biased towards each other to define the pinch point, and the contact tines 400 and 405 may be biased towards each other to define the pinch point. The contact tines that are biased towards each other separate and engage the core or strands 130 of the wire as the wire (e.g., the first wire 105, the second wire 110, the third wire 115) is inserted through the contact tines. The pinch point 420 may perform a clamping mechanism to prevent inadvertent removal or unnecessary movement of the wire (e.g., the first wire 105, the second wire 110, the third wire 115) upon insertion into the contact 200.

Each contact tine in the first set of contact tines 320, the second set of contact tines 330, and the third set of contact tines 340 may also define a contact point 425 towards an end portion of the contact tine near the pinch point 420. The contact point 425 may provide a location for electrical contact between the wire (e.g., the first wire 105, the second wire 110, the third wire 115) and the associated contact tine through which the wire in inserted. Although the contact point 425 is shown to have a specific shape and size, in other embodiments, the configuration of the contact point may vary. In some embodiments, the contact point 425 of each contact tine in the first set of contact tines 320, the second set of contact tines 330, and the third set of contact tines 340 may have a distal end that flares away towards the side walls (e.g., the side walls 270A, 270B, 295A, 295B) of the contact 200. For example, the distal ends of the contact tines 385 and 390 near the contact point 425 may be biased away from each other and outwardly towards the side walls 270A and 270B. The distal ends of other pairs of contact tines may be similarly biased away from the path of wire insertion. The above configuration of each contact tine in the first set of contact tines 320, the second set of contact tines 330, and the third set of contact tines 340 prevents accidental removal of the wire (e.g., the first wire 105, the second wire 110, the third wire 115) upon insertion, while providing a more intimate electrical contact to the wire via the contact point (e.g., the contact point 425).

Further, although not shown, in some embodiments, the first contact portion 240 and the splice contact portion 245 may include a wire stop to provide a surface against which the core or strands 130 of the wire (e.g., the first wire 105, the second wire 110, the third wire 115) may abut in the completely inserted position of the wire. The wire stop may assume various configurations as desired. In some embodiments, the wire stop may be formed from the single metal sheet from which the first contact portion 240 and the splice contact portion 245 are defined. For example, in some embodiments, the wire stop may be formed from a bent-up portion of the bottom walls 265, 290 such that the wire stop extends upwards from the bottom wall into the cavity of the first contact portion 240 and the splice contact portion 245. In other embodiments, the wire stop may be formed from cutouts in the top walls 260, 285, or the side walls 270A, 270B, 295A, and/or 295B. In some embodiments, a single wire stop may be provided, while in other embodiments, multiple wire stops may be provided.

The wire guides in the set of wire guides 345 may be configured similar to the contact tines. Thus, the first wire guide 410 and the second wire guide 415 may be formed from cutouts in the top wall 285 and the bottom wall 290, respectively. The cutouts may be bent or angled inwards into the cavity of the splice contact portion 245. The first wire guide 410 and the second wire guide 415 may be biased towards each other. In some embodiments, the first wire guide 410 and the second wire guide 415 may be close enough to each other to define a pinch point similar to the pinch point 420. In other embodiments, the first wire guide 410 and the second wire guide 415 may be biased towards each other but far apart so as not to define a pinch point. In some embodiments, the first wire guide 410 and the second wire guide 415 may also include a contact point similar to the contact point 425.

Thus, the contact tines in the first set of contact tines 320, the second set of contact tines 330, and the third set of contact tines 340, and the first wire guide 410 and the second wire guide 415 facilitate easy insertion and guidance of the wire (e.g., the first wire 105, the second wire 110, the third wire 115) into the contact 200 to secure the wire into position and facilitate easy removal of the wire when desired.

Returning back to FIGS. 4A and 4B, as discussed above, the first contact portion 240 and the splice contact portion 245 may be formed from a single conductive material. In some embodiments, a configuration of tabs and recesses may be used to create the first contact portion 240 and the splice contact portion 245. For example, to create the first contact portion 240, the conductive material may include one or more tabs at the longer edge of the conductive material, such that the edge upon bending forms the side wall 270A. For example, the first contact portion 240 includes a first tab 430 (see FIG. 6A) and a second tab 435. In some embodiments, the first tab 430 may be formed closer to the first end 325 of the first contact portion 240, while the second tab 435 may be formed closer to the second end 335 of the first contact portion. Although two tabs (e.g., the first tab 430 and the second tab 435) are shown in the first contact portion 240, in some embodiments, a single tab or more than two tabs may be provided. Each of the first tab 430 and the second tab 435 may be formed by defining a protrusion in the conductive material. The protrusion may be sized to fit into a recess. For example, the protrusion of the first tab 430 may be sized to fit into a first recess 440 (see FIG. 4B) and the protrusion of the second tab 435 may be sized to fit into a second recess 445 (see FIG. 4B).

The first and second recesses 440 and 445, respectively, may be formed as cutouts in the bottom wall 265. In some embodiments and as shown in FIG. 4A, the first recess 440 may be formed on the bottom wall 265 such that the first recess is completely encompassed and the bottom wall extends past the side wall 270. Thus, the bottom wall 265 may include an extension portion 250 that extends past the first recess 440 and beyond the side wall 270A. Although not visible, the second recess 445 may be similarly completely encompassed the bottom wall 265 extending past the side wall 270A. Thus, in some embodiments, the extension portion 250 may extend from the first end 325 to the second end 335 encompassing the first recess 440 and the second recess 445. By engaging the first tab 430 into the first recess 440 and engaging the second tab 435 into the second recess 445, and extending the bottom wall 265 past the side wall 270A as the extension portion 250, the rigidity and stability of the first contact portion 240 upon formation may be improved. In other embodiments, the extension portion 250 need not be provided and the first recess 440 and/or the second recess 445 may be formed substantially at the edge of the bottom wall 265.

Similarly, a configuration of tabs and recesses may be used to create the splice contact portion 245. For example, the conductive material may define a third tab 450 (see FIG. 6B) on the opposite edge on which the first tab 430 and the second tab 435 are defined. The third tab 450 may include a protrusion that is configured to engage with a third recess 455 (see FIG. 4B). The third recess 455 may be defined from a cutout on the bottom wall 290. In some embodiments, the third recess 455 may be completely encompassed by the bottom wall 290 and having the extension portion 250. It is to be understood that although the bottom wall 265 of the first contact portion 240 and the bottom wall 290 of the splice contact portion 245 are described as separate bottom walls, both bottom walls are one contiguous bottom wall formed from the same conductive material. Similarly, although the top walls 260, 285 are described as separate top walls, those top walls are defined from the same conductive material from which the first contact portion 240 and the splice contact portion 245 are formed. Likewise, the side walls 270A, 270B, 295A, 295B are defined from the same conductive material.

Although a single tab has been shown for the third tab 450 on the splice contact portion 245, in some embodiments, greater than one tab may be used on the splice contact portion. The third tab 450 upon engaging with the third recess 455 increases the rigidity and stability of the splice contact portion 245. In some embodiments, the first recess 440 and the third recess 455 may be formed as a single wide recess within which both the first tab 430 and the third tab 450 may be inserted. In some embodiments, the first recess 440 and the third recess 455 may be formed as separate recesses. Further, although the first recess 440 and the third recess 455 are shown as abutting each other or at least adjacent to each other and aligned, in some embodiments, those recesses may be spaced apart and offset from one another. Further, the shape and size of the third tab 450 and the third recess 455 may be same as or different than the shape and size of the first tab 430/first recess 440 and/or the second tab 435/second recess 445. The bending of the conductive material to form the first contact portion 240 and the splice contact portion 245 using the first tab 430, the second tab 435, and the third tab 450, as well as the first recess 440, the second recess 445, and the third recess 455 is discussed in FIG. 7 below.

Additionally, although in some embodiments, the first contact portion 240 and the splice contact portion 245 are formed from a single conductive material, in other embodiments, the first contact portion and the splice contact portion may be formed from separate conductive materials and connected together in operational association.

Figure 6A:
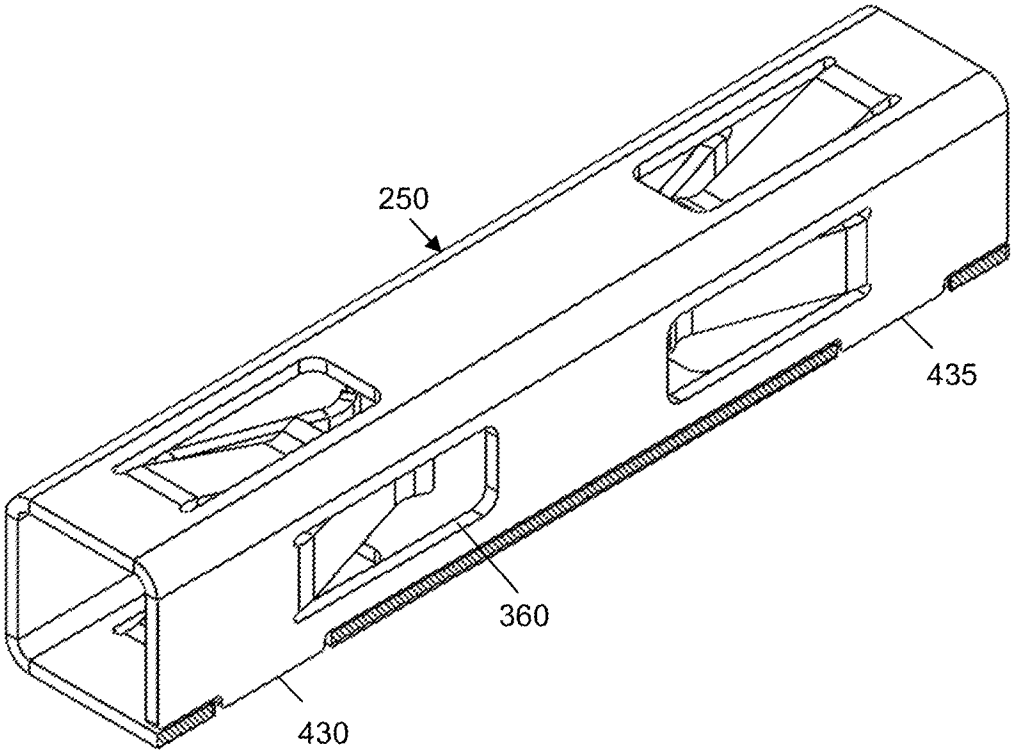
FIGS. 6A and 6B are cut-away views showing the first contact portion and the splice contact portion, respectively, of the contact of FIGS. 4A and 4B, in accordance with some embodiments of the present disclosure.
Figure 6B:
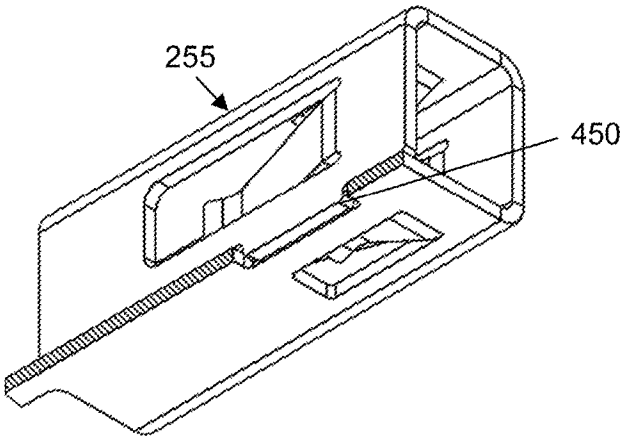

Turning now to FIGS. 6A and 6B, perspective views of the first contact portion 240 and the splice contact portion 245, respectively, are shown, in accordance with some embodiments of the present disclosure. Although the contact 200 has been described herein as having both the first contact portion 240 defined by the first contact portion 240 and the splice contact portion 245 defined by the splice contact portion 245, in some embodiments, the contract portion may include either the first contact portion or the splice contact portion, as shown in FIGS. 6A and 6B. The first contact portion 240 and the splice contact portion 245 may still be formed as discussed above with the configuration of tabs/recesses even when the contact 200 includes either the first contact portion 240 or the splice contact portion 245.

Figure 7:
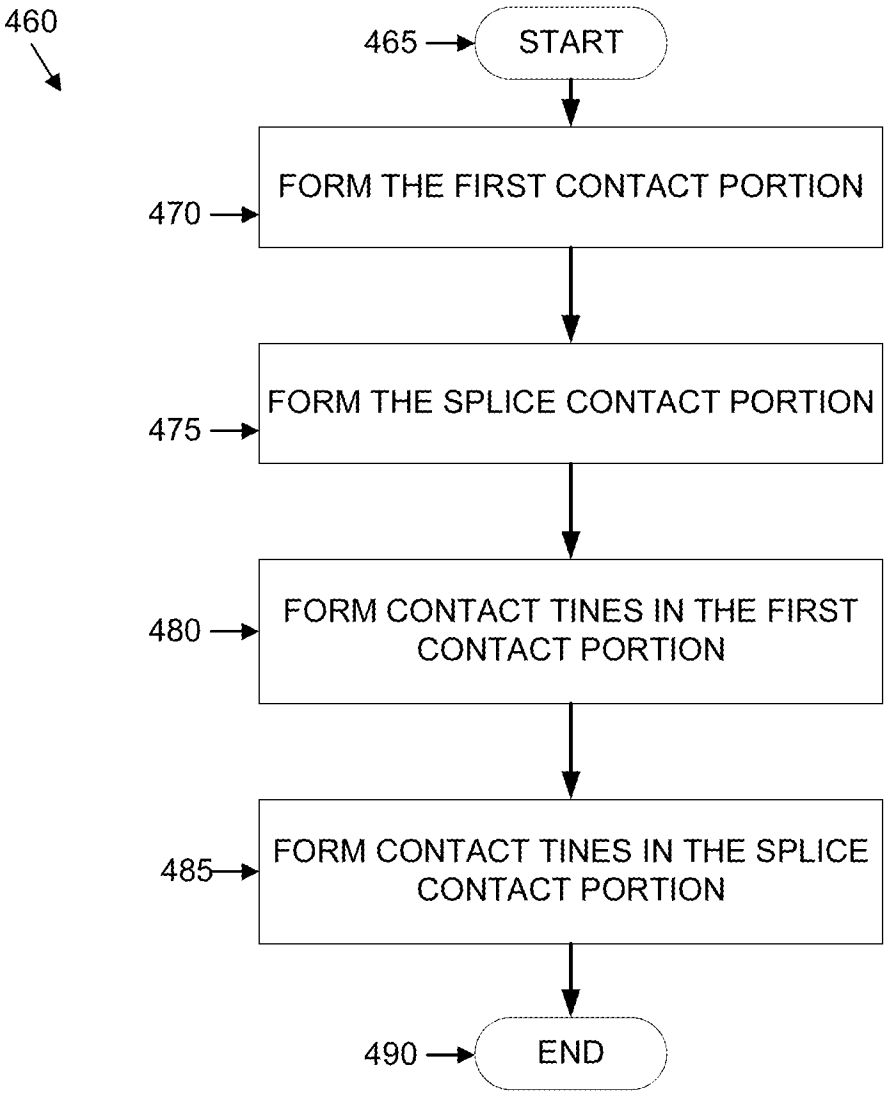
FIG. 7 is an example flowchart outlining operations for manufacturing the electrical connector of FIG. 1, in accordance with some embodiments of the present disclosure.

Referring to FIG. 7, an example flowchart outlining operations of a process 460 is shown, in accordance with some embodiments of the present disclosure. The process 460 may be used to manufacture or otherwise assemble the contact 200. The process 460 may be used to manufacture the contact 200 using traditional manufacturing techniques or by using 3D printing. Thus, upon starting at operation 465, the first contact portion 240 is formed at operation 470. The formation of the contact 200 may begin with a single conductive material. For example, a single metal sheet may be used to create the contact 200. In other embodiments, other types of conductive material may be used. In some embodiments, an L-shaped or substantially L-shaped metal sheet may be used to create the contact 200. The L-shaped metal sheet may be molded, bent, or otherwise deformed to form the first contact portion 240. One or more tabs and corresponding recesses may be formed on the metal sheet to form the first contact portion 240.

Specifically, in some embodiments, the protrusions for the one or more tabs (e.g., the first tab 430, the second tab 435) may be defined on the edge of the metal sheet that upon folding forms the side wall 270A. For each tab, a corresponding recess may be defined on the metal sheet. For example, the recess may be defined on the surface of the metal sheet that upon folding forms the bottom wall 265. The shape and size of each recess may be based upon the shape and size of the tab that the recess is designed to engage with. Upon forming the one or more tabs, and the recesses corresponding to each tab, the metal sheet may be folded, bent, or deformed into a box structure by engaging each tab into a corresponding recess. Specifically, in some embodiments, the end of the metal sheet having the tab protrusions may be folded to form a first fold defining the bottom wall 265 and the side wall 270B, a second fold defining the top wall 260, and a third fold defining the side wall 270A. With the third fold, the tab protrusions may be extended to engage with the corresponding recesses, thereby defining the first contact portion 240. In other embodiments, the various folds may be formed in a different order to form the first contact portion 240. In some other embodiments, the end of the metal sheet having the recesses may be folded by way of multiple folds to form the first contact portion 240 upon engaging with the corresponding tabs. Upon forming the first contact portion 240, the L-shaped metal sheet may still have an L-shaped configuration with the first contact portion extending along the longer length of the L-shape.

At operation 475, the splice contact portion 245 is formed. The splice contact portion 245 is formed from the same metal sheet from which the first contact portion 240 is formed. In some embodiments, the splice contact portion 245 may be formed before the first contact portion 240. Further, the splice contact portion 245 may be formed similar to the first contact portion 240 by forming one or more tabs, and a recess corresponding to each tab. Thus, the third tab 450 is formed by forming a protrusion on the edge of the metal sheet that is opposite to the edge on which the tabs for the first contact portion 240 are formed. A corresponding recess (e.g., the third recess 455) is formed on the surface of the metal sheet to engage with the tab. The end of the metal sheet having the third tab 450 for the splice contact portion 245 may then be folded several times to form the splice contact portion 245 upon engaging the tab with the third recess 455. In some embodiments, the third recess 455 for the splice contact portion 245 may be adjacent to (e.g., abutting) the first recess 440 formed for the first contact portion 240 (e.g., as shown in FIG. 4B). Thus, upon folding the metal sheet to form the splice contact portion 245, the side wall 295A of the splice contact portion 245 may abut the side wall 270A of the first contact portion 240.

Thus, by folding, deforming, and/or bending a single metal sheet, the first contact portion 240 and the splice contact portion 245 may be created. At operations 480 and 485, the contact tines may be formed in the metal sheet for the first contact portion 240 and the splice contact portion 245, respectively. In some embodiments, the contact tines may be formed in the metal sheet before folding the metal sheet to form the first contact portion 240 and the splice contact portion 245. In other embodiments, the contact tines may be formed after folding the metal sheet to form the first contact portion 240 and the splice contact portion 245. To form a contact tine, a cutout may be defined in the metal sheet of a desired shape and size. Although the cutout is shown as being rectangular in shape in the figures, the cutout may assume any desired shape. Further, as shown, the cutout is created such that the portion of the metal sheet being cut out is not completely severed from the metal sheet. For example, when the cutout is rectangular in shape, the metal sheet may be cut on three sides of the rectangle to form a contact tine. The cut out metal sheet may then be deformed and bent towards and into the cavity of the first contact portion 240 and the splice contact portion 245 on which the cut out is formed. In this way, the first set of contact tines 320, the second set of contact tines 330, and the third set of contact tines 340 may be formed.

Additionally, the set of wire guides 345 may be formed for the splice contact portion 245 in a similar way as the contact tines. In some embodiments, any sharp edges of the contact 200 may be covered with a sealing member to improve handling. The process 460 ends at operation 495.

When 3D printing is used to manufacture the contact 200, the process 460 may be used with some variations. For example, in some embodiments, the formation of the tabs and recesses may not be needed. Thus, each of the first contact portion 240 and the splice contact portion 245 may be created as boxed portions to form the first contact portion 240 and the splice contact portion 245 in a unitary piece. Further, in some embodiments, the contact tines and wire guides may be 3D printed as the first contact portion 240 and the splice contact portion 245 are being printed.

Thus, the contact of the present disclosure provides a mechanism to easily and reliably electrically and mechanically connect one wire to one or more other wires.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A contact for a wire-to-wire electrical connector, the contact comprising:

a first contact portion defining:

a first wire receiving opening to receive a first wire; and a second wire receiving opening to receive a second wire; and a splice contact portion abutting the first contact portion and defining a third wire receiving opening to receive a third wire, wherein the first contact portion and the splice contact portion extend parallel to each other along a first direction, and wherein the first contact portion is longer than the splice contact portion in the first direction, wherein the first contact portion comprises a first plurality of contact tines to electrically connect the first wire and the second wire; and wherein the splice contact portion comprises a second plurality of contact tines to electrically connect the third wire to the first wire and the second wire.

2. The contact of claim 1, wherein the contact is disposed with a housing comprising:

a first portion comprising a plurality of latching prongs disposed around a periphery of the first portion; and a second portion comprising a plurality of cutouts disposed around the periphery of the second portion, wherein each of the plurality of latching prongs is configured to engage with one of the plurality of cutouts to define a volume;

wherein the contact is disposed within the volume; and wherein the second portion and the first portion upon interlocking define:

a first opening to receive the first wire;

a second opening to receive the second wire; and a third opening to receive the third wire.

3. The contact of claim 1, wherein the first contact portion and the splice contact portion are formed from a single sheet of a conductive material.

4. The contact of claim 1, wherein the first plurality of contact tines of the first contact portion comprises a first set of contact tines adjacent to a first end of the first contact portion and a second set of contact tines adjacent to a second end of the first contact portion, and wherein the second plurality of contact tines of the splice contact portion comprises a third set of contact tines adjacent to the first end of the first contact portion.

5. The contact of claim 4, wherein each of the first set of contact tines and the second set of contact tines comprises:

a first contact tine on a first wall of the first contact portion;

a second contact tine on a second wall of the first contact portion, wherein the second wall is opposite the first wall;

a third contact tine on a third wall of the first contact portion; and a fourth contact tine on a fourth wall of the first contact portion, wherein the fourth wall is opposite the third wall, wherein the first contact tine and the second contact tine are offset from the third contact tine and the fourth contact tine.

6. The contact of claim 5, wherein:

the first contact tine and the second contact tine are disposed at a first distance from the first end of the first contact portion;

the third contact tine and the fourth contact tine are disposed at a second distance from the first end of the first contact portion; and the second distance is greater than the first distance.

7. The contact of claim 4, wherein the third set of contact tines comprises a first contact tine on a first wall of the splice contact portion and a second contact tine on a second wall of the splice contact portion, and wherein the second wall is opposite to the first wall.

8. The contact of claim 1, wherein the first contact portion further comprises a tab on a first wall of the first contact portion and a recess on a second wall of the first contact portion, wherein the tab is configured to engage with the recess to define the first wire receiving opening and the second wire receiving opening.

9. The contact of claim 1, wherein the splice contact portion further comprises a tab on a first wall of the splice contact portion and a recess on a second wall of the splice contact portion, wherein the tab is configured to engage with the recess to define the third wire receiving opening.

10. The contact of claim 1, wherein the splice contact portion further comprises a wire guide to guide the third wire through the second plurality of contact tines.

11. A contact for a wire-to-wire connector, the contact comprising:

a first contact portion comprising:

a first wire receiving opening to receive a first wire;

a second wire receiving opening to receive a second wire;

a first tab on a first wall of the first contact portion and a first recess on a second wall of the first contact portion, wherein the first tab is configured to engage with the first recess to define the first wire receiving opening and the second wire receiving opening; and a splice contact portion abutting the first contact portion and comprising:

a third wire receiving opening to receive a third wire; and a second tab on a third wall of the splice contact portion and a second recess on a fourth wall of the splice contact portion, wherein the second tab is configured to engage with the second recess to define the third wire receiving opening.

12. The contact of claim 11, wherein the first contact portion further comprises a third tab on the first wall and a third recess on the second wall, wherein the third tab is configured to engage with the third recess, and wherein the first tab and the second tab are adjacent to a first end of the first contact portion and the third tab is adjacent to a second end of the first contact portion.

13. The contact of claim 11, wherein the first recess and the second recess abut each other.

14. The contact of claim 11, wherein the first contact portion further comprises a first set of contact tines adjacent to a first end of the first contact portion and a second set of contact tines adjacent to a second end of the first contact portion to electrically connect the first wire and the second wire, and wherein the splice contact portion comprises a third set of contact tines adjacent to the first end to electrically connect the third wire to the first wire and the second wire.

15. The contact of claim 14, wherein the splice contact portion further comprises a set of wire guides adjacent to the first end to guide the third wire between the third set of contact tines.

16. A contact for a wire-to-wire connector, the contact comprising:

a first contact portion comprising:

a first tab on a first wall of the first contact portion;

a first recess on a second wall of the first contact portion, wherein the first tab is configured to engage with the first recess to define a first wire receiving opening to receive a first wire and a second wire receiving opening to receive a second wire; and a plurality of contact tines to electrically connect the first wire to the second wire.

17. The contact of claim 16, further comprising a splice contact portion abutting the first contact portion.

18. The contact of claim 17, wherein the first portion and the splice contact portion are formed from a single metal sheet.

* * * * *